United States Patent [19]

Schmidgall et al.

[11] Patent Number: 4,989,388

[45] Date of Patent: Feb. 5, 1991

[54] SPACER FOR SPACING REINFORCING MESH WIRE FROM THE FORM IN THE MANUFACTURE OF CONCRETE PIPE AND THE LIKE

[75] Inventors: Jon A. Schmidgall; Galen G. Metzger, both of Des Moines, Iowa

[73] Assignee: Hawkeye Concrete Products Co., Cedar Rapids, Iowa

[21] Appl. No.: 314,801

[22] Filed: Feb. 24, 1989

[51] Int. Cl.[5] ..... E04C 5/16

[52] U.S. Cl. ..... 52/687; 52/652

[58] Field of Search ..... 52/652, 677, 680, 682, 52/684, 687, 689, DIG. 1

[56] References Cited

U.S. PATENT DOCUMENTS

| | | | |
|---|---|---|---|
| 3,257,767 | 6/1966 | Lassy | 52/652 |
| 3,440,792 | 4/1969 | Schmidgall | 52/652 X |
| 3,471,986 | 10/1969 | Swenson | 52/652 |
| 4,301,638 | 11/1981 | Schmidgall | 52/687 |
| 4,835,934 | 6/1989 | Swenson | 52/687 |

OTHER PUBLICATIONS

C.M.C.—Spacers for Reinforced Concrete Pipe; 1/1976.

*Primary Examiner*—David A. Scherbel
*Assistant Examiner*—Creighton Smith
*Attorney, Agent, or Firm*—James C. Nemmers

[57] ABSTRACT

A spacer for attachment to the wires of a reinforcement cage that must be held away from the surfaces of a concrete form or wall used in producing concrete products, such as concrete pipe. The cage spacer is formed of a continuous piece of round spring-steel wire and has a closed loop formed at one end that hooks on a wire of the reinforcement cage. The closed loop connects two parallel spaced-apart legs that provide a spacing nose, the legs terminating at the other end of the spacer in an S-shaped hook that snaps over another of the wires of the cage. In the preferred embodiment, one lower leg is wrapped over and around the other leg to provide additional stability to the spacer.

1 Claim, 1 Drawing Sheet

SPACER FOR SPACING REINFORCING MESH WIRE FROM THE FORM IN THE MANUFACTURE OF CONCRETE PIPE AND THE LIKE

BACKGROUND OF THE INVENTION

It is well known in the art of manufacturing concrete pipe and other similar structures, such as manholes, box sections, catch basins, septic tanks and the like (hereinafter simply "product" or "products"), that a reinforcing wire mesh cage or cages must be provided to produce a product of the required strength. In order to produce a quality concrete product, the reinforcing cage must be positioned so that it will be a predeterimed distance from the inside and outside walls of the finished product. In order to achieve this result, the cage must be properly positioned inside of the space between the forms used to produce the product. The cage cannot, of course, be manufactured to sufficiently close tolerances that it will fit perfectly in the space between the forms at the proper distance from the surfaces of the form walls. More importantly, the cage will be subjected to various forces during the manufacturing process, and it is therefore essential that the cage be properly positioned from the walls of the form and maintained the required distance throughout the casting process. In order to accomplish the proper spacing, there are commonly provided spacing elements which can be fastened to the cage to space it from and maintain it the proper distance from the form walls.

These spacers must also be designed so as to avoid the creation of voids in the finished product, since the product generally must meet specifications that require resistance to hydrostatic pressure. During the casting process, stresses are created on the spacers. When the forms are stripped and while the concrete is still uncured, the forms no longer hold the spacers and these stresses are relieved, allowing the spacers to "pop out". This can create surface bulges and cracks or voids which may produce a hydrostatic leak in the finished product that allows water to enter the structure. Once inside the concrete product, the water will follow leak channels throughout the entire structure because the water will follow the mesh reinforcing cage. Therefore, the structure must be water tight to meet the hydrostatic specifications for such structures, and in order to meet these specifications, it is essential that the spacers resist the forces exerted upon them during the casting process. Hydrostatic problems can also occur if voids are created around the spacers during the casting process. These voids occur if the profile of the spacer does not allow concrete to flow around the spacer.

The two commonly used methods of producing concrete products create different forces on a reinforcing cage and thus upon the spacers used in connection with the cage. In one such method of casting concrete products, an annular space is provided by an inner core and outer jacket which comprise the mold set. The most common procedure is to lower the jacket over the core after the cage is in place. Unless the spacer used is capable of resisting the downward axial forces applied as the jacket is lowered in place, the spacers can be dislodged or distorted.

In another commonly used method of producing concrete products, especially concrete pipe, a packer head rotates inside of an outer cylindrical form so as to pack the concrete through the reinforcing cage and against the wall of the outer form. In this process, the jacket or outer form hinges open and shut, and therefore there is a jacket splice which tends to get out of alignment creating a catch point at the splice. Thus, when this process is used, the spacers for the reinforcing cage must be capable of resisting not only the axial forces that occur, but also the forces upon the spacers as the cage tends to twist during rotation of the packer head. This twisting of the cage can not only dislodge or distort the spacers, but it also drags them along the inside of the jacket and across the jacket splice. The spacers then may tend to catch on the splice or gouge or scar the inner surface of the jacket. There are known a number of different spacers which have been designed in an attempt to resist all of the forces exerted upon the spacers during the casting process, especially those exerted during the packer head process. One such spacer is disclosed in Swenson U.S. Pat. No. 3,471,986, which shows a spacer formed from a flat band of spring steel so as to be provided with an open hook at each end between which is formed the spacing nose. Because of its design, this spacer often will snag on the packer head jacket splice during twisting of the cage. When this happens, the spacer may bend over causing improper spacing, the spacer may become dislodged or the spacer may become bent over and "pop out" when the form is stripped creating a void, or surface crack or bulge. "Pop out" can also occur with this spacer because it can be easily deflected inwardly due to its inherent design using a thin band of steel. Also, because of the solid and relatively large width of the band of this spacer, flow of the concrete during the casting process can be blocked and create voids that lead to hydrostatic leaks. This spacer also tends to gouge the inner wall of the form when the cage twists during the casting process due to the sharp edges of the band.

Another spacer is shown in Schmidgall U.S. Pat. No. 4,301,638 which discloses a spacer formed from a round spring-steel wire into a generally hair pin shape in which there are a pair of parallel legs joined by a closed loop at one end, with the free ends of the legs being formed into hooks. Although spacers of this type are very satisfactory for use in some of the casting processes, when used in the rotating packer head process, the legs tend to bend over or the spacers can become dislodged from the reinforcing cage.

There is therefore a need for an improved spacer useable in any of the casting processes and designed so as to be capable of resisting forces in all directions so that the spacer will not become dislodged, bent or stressed during the casting process resulting in voids or other defects in the finished product. There is a further need for a spacer that will not gouge the inner surfaces of the jacket, and a spacer which has a profile that will allow the concrete to flow completely around the spacer so as to prevent voids that can result in hydrostatic leaks in the finished product. Such an improved spacer should also be of a design that will permit easy and quick installations, preferably without the use of any special tools. Such an improved spacer should also be inexpensive since large quantities are necessarily used during the production of each concrete product.

SUMMARY OF THE INVENTION

The spacer of the invention provides a unique element formed of a continuous piece of rounded spring-steel wire. The spacer has a closed loop formed at its upper end that will positively hook over a wire of the reinforcing cage. In the preferred embodiment, the closed loop is connected to parallel spaced-apart legs that provide the spacing nose, the legs terminating at the other end of the spacer in an S-shaped hook that snaps over another of the wires of the reinforcing cage and positively locks the spacer in place. In the preferred embodiment, one leg is wrapped over and around the other leg to provide additional stability to the spacer.

DESCRIPTION OF THE PREFERRED EMBODIMENTS OF THE INVENTION

Figure 1:
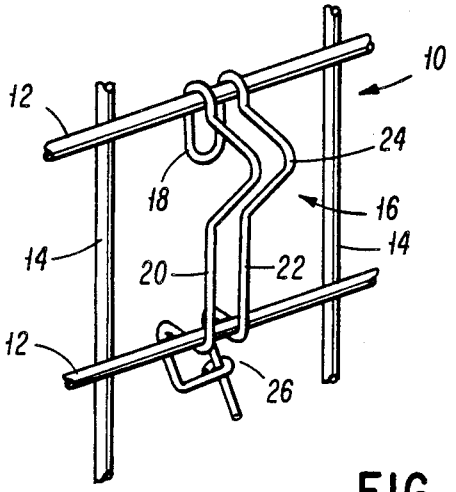
FIG. 1 is perspective view of portion reinforcing cage and showing a spacer constructed according to the invention in place on the cage.
Figure 2:
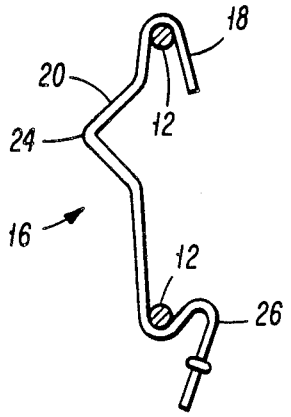
FIG. 2 a side elevational view of the spacer of FIG. 1.

Referring first to the embodiments shown in FIGS. 1 and 2, FIG. 1 shows a representative form of a reinforcing mesh cage 10 that consists of a plurality of relatively uniformly spaced wires that are typically welded at their intersections to provide a unitary product. During the casting process, some wires 12 are oriented horizontally, while other wires 14 are oriented vertically. The spacer, indicated generally by the reference numeral 16, is shown as being positioned on a pair of adjacent horizontal wires 12, thus being in place to serve the spacing function. It will be understood by those skilled in the art that a number of spacers 16 are snapped onto the cage 10 at selected intervals.

The spacer 16 is formed from a continuous length of rounded spring-steel wire that has inherent resiliency so that the spacer 16 can be bent during installation on the cage 10 but will return to its original configuration thus locking the spacer 16 onto the cage 10.

The spacer 16 has at one end, the upper end of FIG. 1, a closed loop that is also bent into a hook 18. The hook 18 is bent so that its free end is sufficiently long to fully wrap around a wire 12 and therefore guard against the spacer 16 coming loose during the casting process.

The closed loop of hook 18 is connected to parallel spaced-apart legs 20 and 22 which extend outwardly and downwardly to form a spacing nose 24. The legs 20 and 22 are spaced apart a sufficient distance to permit the easy flow of concrete between and around them during the casting process. This prevents voids forming around the spacer 16 that could cause hydrostatic leaks. This double-leg construction also prevents the snagging and distortion of the spacer 16 as it passes over a jacket splice during the packer head casting process. Depending upon the direction of rotation of the cage to which the spacer 16 is attached, one of the legs 20 or 22 will be the leading leg which will ride over the jacket splice while the trailing leg continues to space the reinforcing cage 10. As the cage 10 continues to twist, the leading leg will clear the splice and spring back into spacing position as the trailing leg rides over the splice. Also, because the spacer 16 is made from rounded wire, it has no sharp edges, and as the cage 10 twists inside the form, the edges will not gouge or scar the form surface.

The nose 24 is sufficiently rounded to provide for a "shoe horn" effect when the outer-form or jacket is slipped down over the cage 10 preliminary to the casting process. The legs 20 and 22 extend downwardly from the nose 24, and then are formed into a some what S-shape configuration to provide a lower hook 26 that will grip the next adjacent horizontal wire 12. In the preferred embodiment of FIG. 1, leg 20 is then bent over and wrapped around leg 22 to provide additional stability to the spacer 16 preventing the two legs 20 and 22 from collapsing.

Because of the resilience of the spring-steel material from which the spacer 16 is made, it can be easily installed on the cage without the necessity of tools. To install the spacer 16, the closed hook 18 is first slipped over one of the horizontal wires 12. By then by merely pressing inwardly on the spacer 16 by applying force to the legs 20 and 22 in the area around the nose 24, the rounded corners of the hook 26 will ride under the next horizontal wire 12, and after passing over that wire 12, the resiliency of the spacer 16 will lock the spacer 16 into place. Once locked into place, the spacer 16 can withstand a considerable amount of inward force thus making it less likely that it will "pop out" when the form is removed from the concrete product during the stripping process. This is because of the strength of the rounded wire and because most of the inward force is applied to the portions of the legs 20 and 22 directly abutting the horizontal wires 12.

Figure 3:
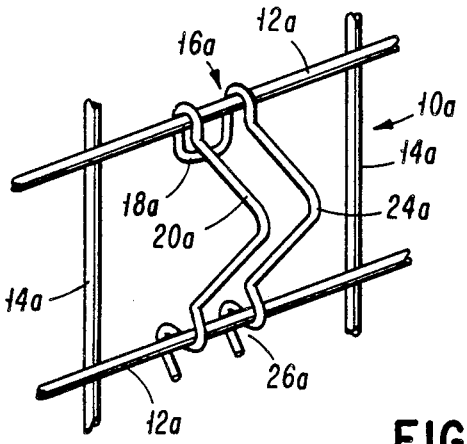
FIG. 3 a perspective view of a second embodiment of the invention, and showing a spacer in place on the reinforcing cage.
Figure 4:
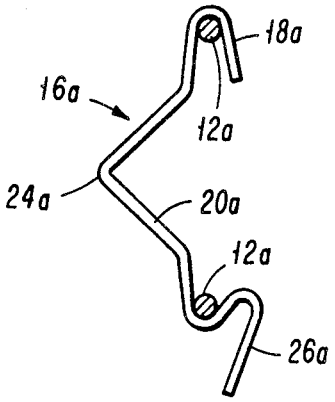
FIG. 4 a side elevational view of the spacer of FIG. 3.

Referring now to FIGS. 3 and 4, there is shown a second embodiment of the invention. In this embodiment, portions corresponding to similar portions of the first embodiment will be referred to using the same reference numeral followed by the letter "a". The spacer **16*a* of the second embodiment has an upper closed hook 18*a* with legs 20*a* and 22*a* extending downwardly and outwardly to form the nose 24*a*. The legs continue downwardly into an S-shaped lower hook 26*a*. Thus, the spacer 16*a* of the second embodiment is substantially similar to the spacer 16 of the first embodiment with the exception that leg 20*a* is not wrapped over and around leg 22*a*. There are some applications where this particular construction would perform equally well, and the embodiment of FIGS. 3 and 4** could be manufactured at a slightly less cost because of elimination of the wrapping of one leg over the other.

Figure 5:
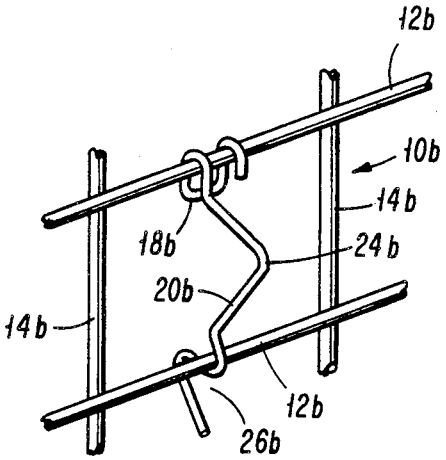
FIG. 5 perspective view of another embodiment of the invention and showing the spacer in place on the reinforcing cage.
Figure 6:
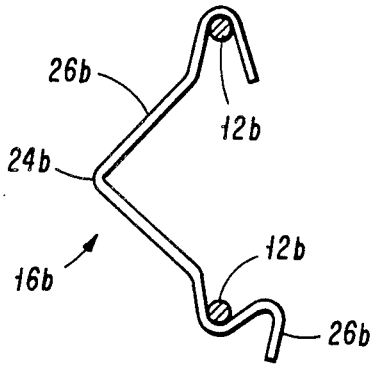
FIG. 6 is a side elevational view of the spacer of FIG. 5.

Referring now to FIGS. 5 and 6, there is shown a single leg version of the spacer. In this embodiment, portions corresponding to similar portions in the first two embodiments will be referred to using the same reference numeral followed by the letter "b". In the embodiment of FIGS. 5 and 6, the spacer **16*b* has an upper closed hook 18*b*, but has only a single leg 20*b* extending downwardly and outwardly to form the nose 24*b*. Leg 20*b* continues downwardly into a somewhat S-shaped lower hook 26*b*. As best seen FIG. 5, the leg 20*b* terminates just after it wraps over the upper wire 12**. Obviously, this embodiment can be made for less cost then either of the two other embodiments, and in certain applications, would be satisfactory. Obviously, it does not have the same stability as the double-leg embodiments.

Having thus described the invention with several embodiments; it will be evident to those skilled in the art, that various other revisions and modifications can be made to the embodiments disclosed herein without departing from the spirit and scope of the invention. It is my intention however, that all such revisions and modifications that are obvious to those skilled in the art will be included within the scope of the following claims.

What is claimed is as follows:

1. For use with a concrete reinforcing cage having parallel spaced-apart horizontal wires which cage is used in concrete products produced in a form that has spaced-apart surfaces, a spacer for maintaining the cage away from the surfaces of the form, said spacer comprising a continuous length of spring-steel material of a substantially round cross-section, a U-shaped loop formed in the material at the upper end of the spacer, the loop being formed to extend over one of the wires of the cage and then downwardly so as to lock over the wire, two generally parallel spaced-apart legs extending outwardly and downwardly from the loop to form a rounded nose that it is engageable with a surface in the concrete form to maintain the cage away from the surface, each of said legs continuing to extend downwardly and then inwardly from the nose to form a locking portion of double somewhat S-shaped hooks at the lower end of the spacer, said S-shaped hooks extending under, inwardly and upwardly and then downwardly around a second one of the wires of the cage parallel to the wire engageable by the loop at the upper end of the spacer, the end of one of the legs being wrapped around the other of the legs, and the spacing between the loop and the S-shaped hooks being such that when the loop is placed over a wire of the cage and the S-shaped hooks are snapped onto a second one of the parallel wires, the resilience of the spring-steel spacer will lock the spacer in place.

* * * * *